US008999415B2

(12) United States Patent
Ramirez et al.

(10) Patent No.: US 8,999,415 B2
(45) Date of Patent: Apr. 7, 2015

(54) TRI-FOLD EGG CARTON FOR JUMBO EGGS

(75) Inventors: Richard L. Ramirez, Lawrenceville, GA (US); Mark A. Bergeron, Monroe, GA (US)

(73) Assignee: Tekni-Plex, Inc., King of Prussia, PA (US)

( * ) Notice: Subject to any disclaimer, the term of this patent is extended or adjusted under 35 U.S.C. 154(b) by 83 days.

(21) Appl. No.: 13/349,360

(22) Filed: Jan. 12, 2012

(65) Prior Publication Data

US 2013/0183412 A1 Jul. 18, 2013

(51) Int. Cl.

| | |
|---|---|
| ***B65D 5/50*** | (2006.01) |
| ***B65D 77/04*** | (2006.01) |
| ***B65D 85/32*** | (2006.01) |

(52) U.S. Cl.

CPC ..... *B65D 77/0413* (2013.01); *B65D 85/324* (2013.01)

(58) Field of Classification Search

CPC ..... B65D 85/324; B65D 85/32; B65D 85/30; B65D 77/0413

USPC ..... 426/112, 119, 298, 614; 206/521–521.9, 523, 586, 515

See application file for complete search history.

(56) References Cited

U.S. PATENT DOCUMENTS

| | | | | | |
|---|---|---|---|---|---|
| 1,846,561 | A | * | 2/1932 | Koppelman | 206/521.1 |
| 2,446,264 | A | * | 8/1948 | Cox | 206/521.1 |
| 2,569,681 | A | * | 10/1951 | Lennon | 206/521.8 |
| 2,600,130 | A | * | 6/1952 | Schilling | 206/521.8 |
| 2,655,305 | A | * | 10/1953 | Schilling | 206/521.8 |
| 2,668,652 | A | * | 2/1954 | Russell | 206/521.1 |
| 2,739,750 | A | * | 3/1956 | Cox | 206/521.8 |
| 2,756,918 | A | * | 7/1956 | Schwartzberg | 206/521.1 |
| 2,843,304 | A | * | 7/1958 | Reifers | 206/521.1 |
| 2,865,548 | A | * | 12/1958 | Stewart | 206/521.8 |
| 2,990,094 | A | * | 6/1961 | Reifers | 206/521.1 |
| 3,244,346 | A | * | 4/1966 | Tijunelis | 206/521.1 |
| 3,298,594 | A | * | 1/1967 | Makowski et al. | 206/521.1 |
| 3,356,284 | A | * | 12/1967 | Lake | 206/521.1 |
| 3,643,857 | A | * | 2/1972 | Noguchi | 206/521.8 |

(Continued)

FOREIGN PATENT DOCUMENTS

CA 2028229 4/1992

OTHER PUBLICATIONS

Tri-fold quail eggs carton (Feb. 2, 2009) (http://web.archive.org/web/20090202042432/http://tristatefarmersmarket.com/quail%20egg%20cartons.htm).*

(Continued)

*Primary Examiner* — Rena L Dye
*Assistant Examiner* — C Smith
(74) *Attorney, Agent, or Firm* — Novak Druce Connolly Bove + Quigg LLP

(57) ABSTRACT

A tri-fold plastic egg carton for protecting jumbo eggs in both oriented and non-oriented positions. A cell base and cell cover are hingedly connected in a closed position with the cover over the base to form a complimentary 2×6 matrix of cell pockets for holding individual eggs. A lid is hingedly connected to another edge of the base for closing over the assembled cover and base. The non-hinged peripheral edges of the base, cover and lid form a trim perimeter having a turned up lip edge, the lip edges mating when the carton is in the closed position to increase the carton strength. The carton can accommodate a full range of jumbo eggs, and accept a variety of smaller size eggs, while fitting within standard cases and half-cases.

19 Claims, 12 Drawing Sheets

(56) References Cited

U.S. PATENT DOCUMENTS

| | | | | |
|---|---|---|---|---|
| 3,908,891 | A * | 9/1975 | Jackson | 206/521.15 |
| D306,138 | S | 2/1990 | Congleton et al. | |
| D307,387 | S | 4/1990 | Payne et al. | |
| D308,822 | S | 6/1990 | Congleton | |
| 5,494,164 | A | 2/1996 | Ramirez | |
| 5,927,501 | A * | 7/1999 | Herbruck | 206/541 |
| 6,012,583 | A * | 1/2000 | Ramirez | 206/521.1 |
| D506,932 | S | 7/2005 | Ramirez | |
| 7,766,169 | B2 | 8/2010 | St-Onge | |
| 7,775,364 | B1 * | 8/2010 | Archambault et al. | 206/521.1 |
| 2005/0145529 | A1 * | 7/2005 | Andrews et al. | 206/521.1 |
| 2005/0189256 | A1 * | 9/2005 | St-Onge | 206/521.1 |
| 2010/0147730 | A1 * | 6/2010 | Archambault et al. | 206/521.1 |
| 2011/0226656 | A1 * | 9/2011 | Archambault et al. | 206/521.1 |

OTHER PUBLICATIONS

Shell egg packs (Aug. 13, 1958).*

* cited by examiner

TRI-FOLD EGG CARTON FOR JUMBO EGGS

FIELD OF THE INVENTION

The present invention relates to plastic egg cartons and more particularly to a tri-fold egg carton that will protect jumbo eggs in both oriented and non-oriented positions.

BACKGROUND

Egg cartons are subjected to multiple adverse mechanical forces and environmental conditions during filling, handling and transport between distribution centers, store shelves, and the ultimate consumer's home. They typically encounter automated equipment for filling, packaging, loading, unloading, stacking, restacking and transport. During each of these encounters, the goal is to resist egg breakage by stabilizing and holding the eggs in a protected environment, in a carton that can be manufactured in a cost effective manner.

Thus, many factors are taken into consideration in the design of egg cartons. Egg protection, resistance to stress or force, stackability, transportability, moisture resistance, aesthetic appearance, print surface area, weight, nestability/denestability, adaptability to accommodate various size eggs, and consistent manufacturing are factors which may be considered to varying degrees in the design of an egg carton.

Plastic egg cartons are available with flexible walls between the cell pockets to protect the eggs and prevent them from moving into adjacent cell pockets. However, during handling, such as while loading cases of egg cartons onto a grocery pallet, and then stacking the cases 5 to 6 high on the pallet, the cases/cartons may be thrown onto the pallets and/or bump into each other, causing the eggs to come out of their cell pockets and make contact from a hard side impact blow. Also, when scanning bar codes on lid tops, the eggs can be displaced and make contact.

Thus, there is need for an improved egg carton construction to provide better egg protection while encountering the adverse mechanical forces and environmental changes that typically occur during filing, packaging, transportation and storage. At the same time, there is a need to manufacture such cartons in a cost effective manner and to maintain overall carton dimensions within standard case sizes to avoid a redesign of the existing handling equipment.

SUMMARY OF THE INVENTION

The present invention relates to an improved tri-fold plastic egg carton having one or more structural features that enable packaging of jumbo eggs in a 2×6 array in both oriented and non-oriented positions while allowing for easy filling, closing, handling and packing into shipping containers. As used herein, "jumbo eggs" includes a full range of jumbo egg sizes from 2.50 to 2.75 ounces per egg, or 30 to 33 ounces per dozen. The carton will also accept a variety of smaller sized eggs, namely medium, large or extra large eggs. Preferably, the carton can be used with standard egg grade equipment and the carton will fit into standard cases, which include full (30 dozen) or half (15 dozen) corrugated cases, and standard plastic or wire half cases (15 dozen).

In one embodiment, the tri-fold egg carton has a cell base and a cell cover which, when assembled one on top of the other, encapsulate each egg in an individual cell pocket. The cell base and cell cover each include full height cell posts with mating surfaces that engage in the assembled state, and the carton further includes a lid which fits over the cover (of the assembled cover and base), in a secure and locked position. A turned up lip configuration is provided on the trim perimeter of all three compartments of the carton (lid, cover and base), to enhance the stiffness of the trim edge and thus provide a stronger assembled carton. The turned up lip edge also allows for easier handling as it will not cut individuals handling the cartons. The lip edges of the base and cover engage one another in the assembled position, while the lip edge of the lid is disposed over the mating lip edges of the assembled cover and base. Additional inter-locking grooves and projections can be provided on the lid and cover to further secure the assembled carton.

A further embodiment of the invention includes denesting lugs on the interior corners of the lid for offset stacking of empty cartons, providing improved (equal) spacing of adjacent cartons for high speed automation, manual hand packing and/or carton loading into master containers while occupying less storage and/or transportation space. The lid denesting lugs, alone or in combination with lid sidewall reinforcements and/or with the turned up lip edge, further increase the lid and/or carton strength.

In accordance with one embodiment of the invention, the assembled base and cover form a plurality (a 2×6 array) of individual egg cell pockets that can accept the larger, heavier and more fragile jumbo eggs in both oriented and non-oriented positions, versus prior art containers that require a correct (oriented) positioning in the cells. The present invention includes a larger cell construction able to hold a larger jumbo egg that is non-oriented, i.e., enabling the largest diameter of the egg to fit into the cell pocket of the base. By accommodating both oriented and non-oriented eggs, this allows more efficient processing, carton handling and placement into master containers. A larger cell post, between each 2×2 array of cells, provides a wider cell spacing that keeps the larger jumbo eggs a greater distance apart in both the 2-cell and 6-cell directions of the 2×6 array.

In various preferred embodiments, the center distance CD between adjacent cells is in a range of from about 1.87 and about 1.95 inches; the center distance is the distance, measured in a plane parallel to a base plane on which the base of the assembled container rests, between the central transverse cell axes A of two adjacent cells. Each base cell preferably has an outwardly bowed sidewall portion having a major cell diameter MCD, disposed in a plane substantially parallel to the base plane, in a range of about 1.75 to about 2.0 inches. A cell divider between adjacent cells preferably has a depth $D_1$ of from about 0.25 to about 0.50 inches, measured transversely from a top plane C in which the trim perimeter of the base lies, the top plane being substantially parallel to the base plane B.

In accordance with one embodiment of the invention, a tri-fold egg carton is provided comprising:

- a cell base, and a cell cover hingedly connected to one edge of the cell base for pivoting between open and closed positions, the base and cover each having a complimentary 2×6 matrix of cells that together form a 2×6 matrix of cell pockets for holding individual eggs when the cover is closed over the base;
- a lid hingedly connected to another edge of the base for pivoting between open and closed positions, wherein when the cover and base are in the closed position the lid can be closed over the cover to form an assembled carton;
- the non-hinged peripheral edges of the lid, cover and base forming a trim perimeter having a turned up lip edge substantially aligned with an axis transverse to a base plane on which the base of the assembled carton rests, the lip edges of the cover and base mating when the cover is closed over the base, and the lip edge on the lid is disposed over the mating lip edges of the cover and base when the lid is closed over the cover; and each cell pocket is sized to hold a jumbo egg, of from 2.50 and 2.75 ounces per egg, in an oriented or a non-oriented direction in the base cell.

According to one embodiment, the carton comprises a formed sheet of clear solid polyester having a thickness in a range of about 0.013 to about 0.022 inches.

According to one embodiment, wherein each base cell has an outwardly bowed sidewall portion sized to receive a major cell diameter of a jumbo egg.

According to one embodiment, the major cell diameter is in a range of about 1.75 to about 2.0 inches.

According to one embodiment, each cell has a sidewall and the sidewalls of two adjacent cells form a cell divider which prevents contact between eggs in the adjacent cells.

According to one embodiment, the cell divider has a depth of from about 0.25 to about 0.50 inches, wherein the depth is measured transversely from a top plane in which the trim perimeter of the base or cover respectively lies, the top plane being substantially parallel to the base plane.

According to one embodiment, the assembled carton has a length of from about 11.62 to about 11.75 inches, a width of from about 3.95 to about 4.00 inches and a height of from about 2.62 to about 2.75 inches.

According to one embodiment, the assembled carton is filled with jumbo size eggs of between 2.50 and 2.75 ounces per egg.

According to one embodiment, a stack is provided comprising a plurality of the assembled egg cartons arranged in a stack.

According to one embodiment, a container is provided holding the stack.

According to one embodiment, the container holds a full case or half case of the egg cartons.

According to one embodiment, the plastic of which the carton is made is one or more of polystyrene, polyester, polyethylene, or polylatic acid, including polymers, copolymers, mixtures and blends thereof.

According to one embodiment, the carton comprises a clear solid formed sheet of polyester.

According to one embodiment, the carton comprises a formed sheet of polystyrene foam.

According to one embodiment, the lid has a lid sidewall which includes denesting lugs.

According to one embodiment, the lid sidewall has corners and the denesting lugs are disposed in the corners.

According to one embodiment, a method of making the egg carton is provided including forming the carton and the turned up lip edge in a mold, and further comprising cutting transverse to the turned up lip edge to form the trim perimeter.

In accordance with another embodiment of the invention, a tri-fold plastic egg carton is provided comprising:

a cell base and a cell cover hingedly connected to one edge of the cell base for pivoting between open and closed positions, the base and the cover having respective peripheral edges that mate with each other in the closed position, and each of the base and the cover having a complimentary 2×6 matrix of cells that, when the cover is closed over the base, the cells of the cover and base are aligned and form a 2×6 matrix of cell pockets for holding individual eggs, each cell having a bottom and a sidewall extending upwardly from the bottom to form a corresponding one of the cells, a cell post formed at an intersection of four adjacent cells as an extension of the sidewalls of the four adjacent cells and having a central mating surface, wherein when the cover is in the closed position over the base the central mating surfaces of the cell posts of the base and cover mate with one another, a lid hingedly connected to another edge of the base for pivoting between open and closed positions, wherein when the cover and base are in the closed position the lid can be closed over the cover to form an assembled carton, the non-hinged peripheral edges of the base, cover and lid forming a trim perimeter having a turned up lip edge substantially aligned with an axis transverse to a plane on which the base of the assembled carton rests, the lip edges of the cover and base mating when the cover is closed over the base, and the lip edge on the lid is disposed over the mating lip edges of the cover and base when the lid is closed over the cover, and each cell pocket is sized to hold a jumbo egg, of from 2.50 to 2.75 ounces per egg, in an oriented or non-oriented direction in the base cell.

According to one embodiment, each cell sidewall includes:

an outwardly bowed portion between upper and lower substantially linear portions, and wherein the outwardly bowed portion has a diameter in a range of about 1.75 to about 2.0 inches adapted to receive a major diameter of a jumbo egg.

According to one embodiment, the sidewalls of two adjacent cells form a cell divider, the cell divider having a depth, of from about 0.25 to about 0.50 inches, wherein the depth is measured transversely from a top plane in which the trim perimeter of the base or cover respectively lies, the top plane being substantially parallel to the base plane.

BRIEF DESCRIPTION OF THE DRAWINGS

The drawings depict various embodiments of the invention wherein.

DETAILED DESCRIPTION

Figures 1, 1A:
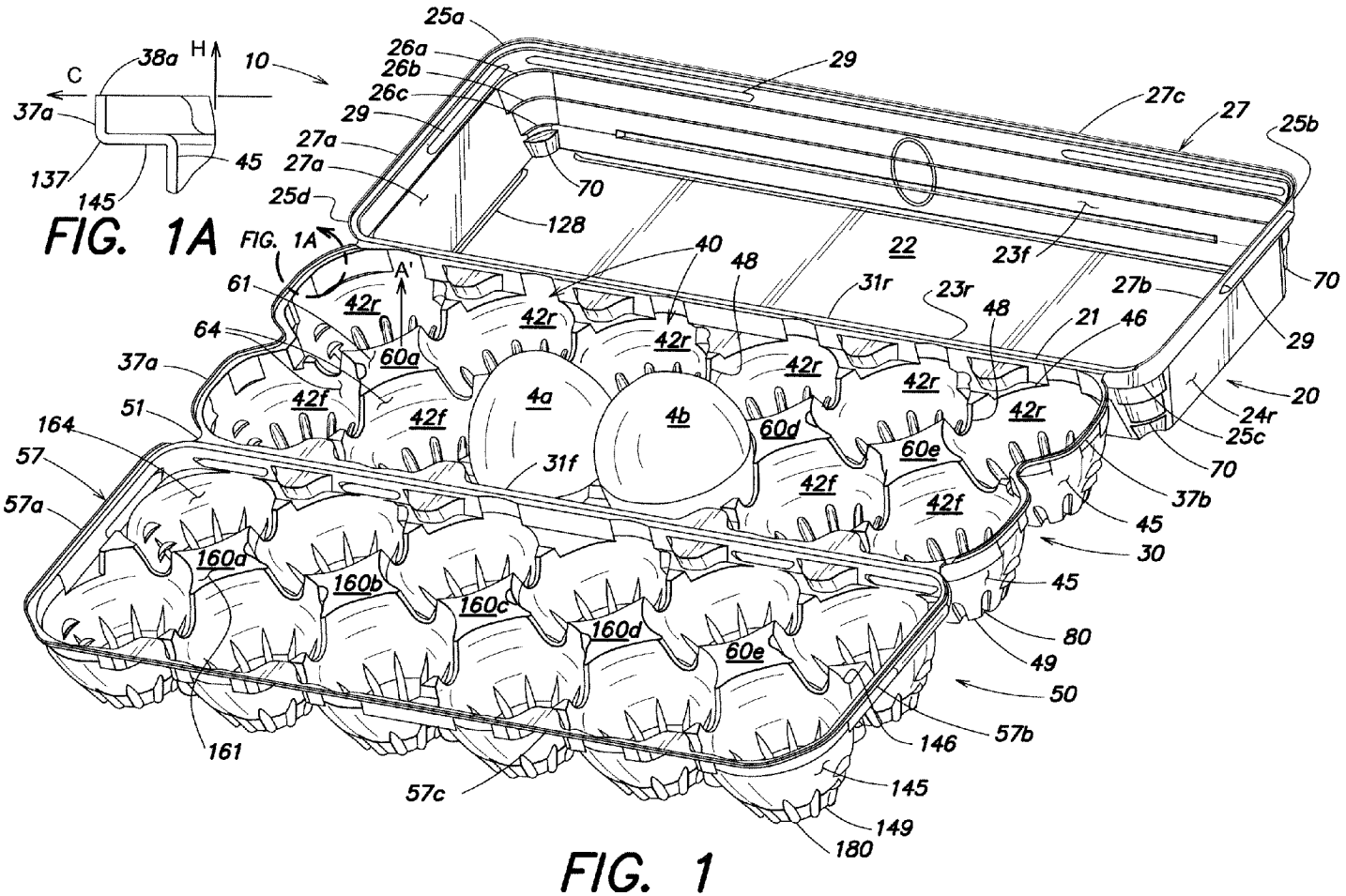
FIG. 1 is a top perspective view of an egg carton according to one embodiment of the invention, showing a hinged cover, base and lid in an open position, with each of the base and cover including a complementary 2×6 matrix of egg receiving cells.
FIG. 1A is an enlarged partial sectional view of a turned up lip edge on the perimeter of the base of the carton of FIG. 1.
Figure 7:
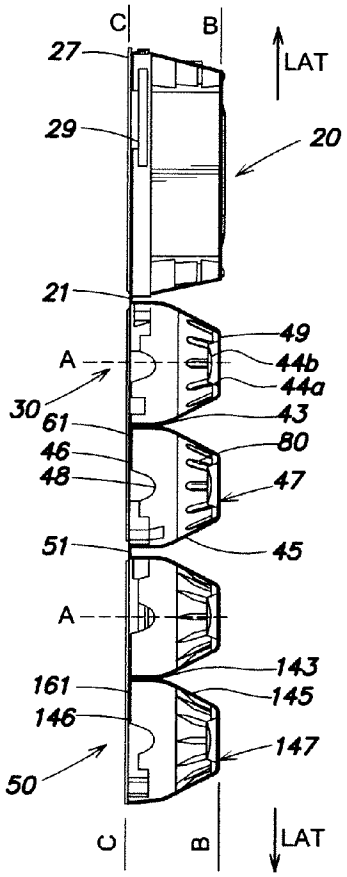
FIG. 7 is a lateral sectional view taken along lines 7-7 of FIG. 6 showing the cell dividers between each adjacent pair of cells in the cover and base.
Figure 8:
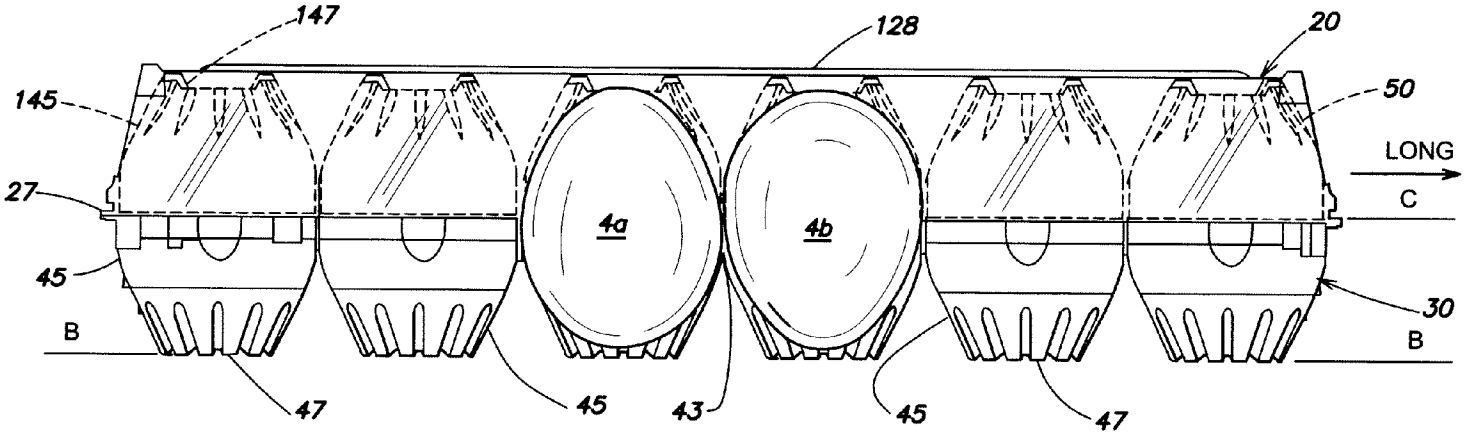
FIG. 8 is a longitudinal partial sectional view of six cell pockets in a row of the assembled carton, with two eggs, one oriented and one non-oriented, shown in the two central cell pockets of the row.
Figure 9:
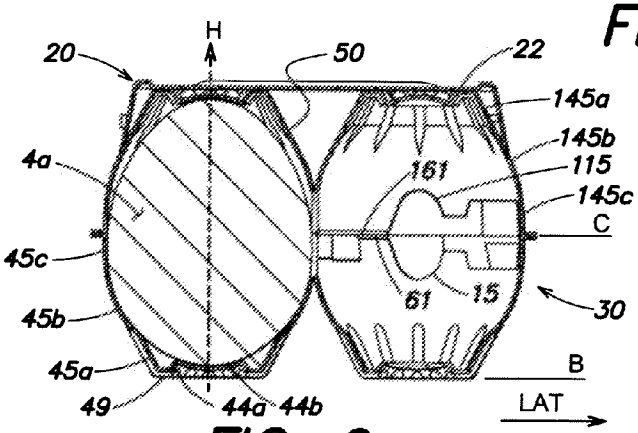
FIG. 9 is a lateral partial sectional view of two cell pockets in the assembled carton showing a non-oriented egg held securely in the left cell pocket.
Figure 10:
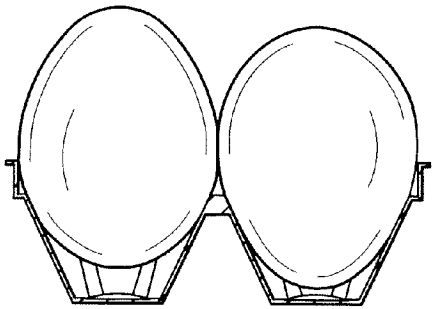
FIG. 10 (Prior Art)
FIG. 10 shows, for comparison, a non-oriented egg engaging an oriented egg in the adjacent cells of a prior art carton.

FIGS. 1-9 illustrate one embodiment of a tri-fold plastic egg carton according to the invention, the carton holding 12 eggs in a 2×6 rectilinear array, with each egg in an individual cell pocket, the cell pockets being formed when a 2×6 array of cells in the cover are positioned over a complementary aligned 2×6 array of cells in the base. The cell pockets are designed to accommodate jumbo eggs in both oriented and non-oriented positions as described in greater detail below. For this purpose, FIG. 1 illustrates two eggs: a non-oriented egg 4*a* on the left and an oriented egg 4*b* on the right. FIGS. 8-9 best illustrate how both oriented and non-oriented jumbo eggs can be accommodated in the assembled carton, each protected in their own cell pocket, without contacting one another.

FIG. 1 is a top perspective view of the interior of an open 2×6 matrix egg carton 10 according to one embodiment of the invention. When closed (see FIGS. 3-5) the carton 10 occupies a volume having a length L, width W, and height H (where H is transverse to a base plane B on where the base of the assembled carton rests). The carton is comprised of a lid 20 connected via hinge 21 to a base 30, the base comprising a plurality of egg receiving cells 40 arranged in the 2×6 matrix. The matrix includes six front cells 42*f* arranged in a row along a front longitudinal edge 31*f* of the base, and six rear cells 42*r* arranged in a second row, parallel to the first row, extending along a rear longitudinal edge 31*r* of the base. At each cross-hair (+) intersection of four adjacent cells (2×2 matrix), a cell post 60 is provided, there being five cell posts 60*a*-60*e* equally spaced apart in a longitudinal row between the first and second rows of cells. Each cell is configured to have an interior contour (shape and dimensions) complimentary to the shape of a jumbo egg 4 (as shown in FIGS. 8 and 9), allowing the egg to be positioned deep in the base cell (with one end of the egg adjacent the bottom wall) in both oriented 4*a* and non-oriented 4*b* positions. As used herein "complimentary" means conforming at least in part to the contour (size and shape) of the egg being held or the surface being mated with. It is contemplated that various sized eggs can be inserted into a base cell, in one or both of an oriented and non-oriented position. An egg has a height extending between a large end and a small end of the egg, and a maximum egg diameter, in a direction transverse to the egg height. In an oriented position in the cell pocket, the small end of the egg is disposed toward the bottom wall of the base cell, with the maximum egg diameter disposed away from the bottom wall of the base cell, whereas in the non-oriented position the egg is oppositely disposed in the base cell.

Figure 2:
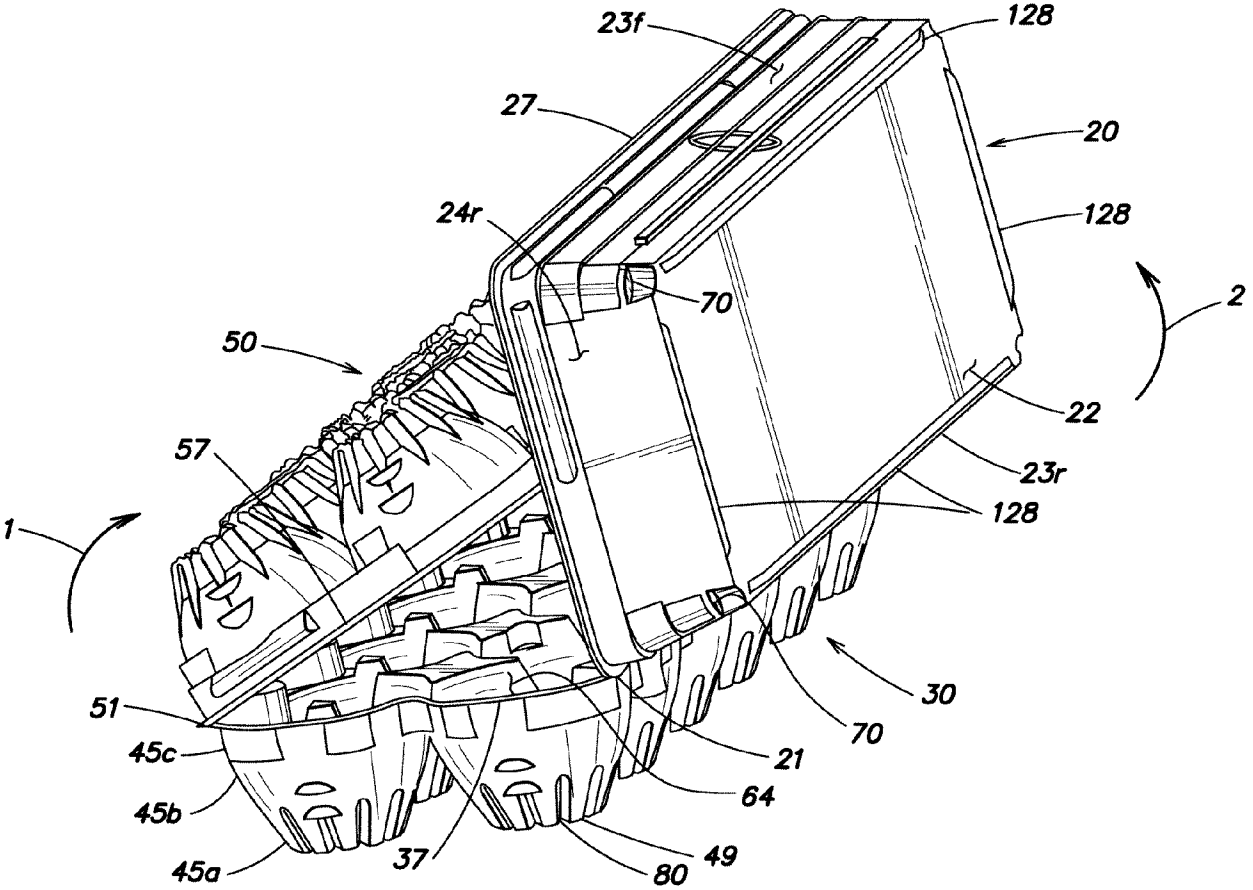
FIG. 2 is an end perspective view of the egg carton of FIG. 1 in a partially assembled position, showing the hinged cover partially folded over the base and (followed by) the hinged lid being folded over the partially assembled cover and base.
Figure 3:
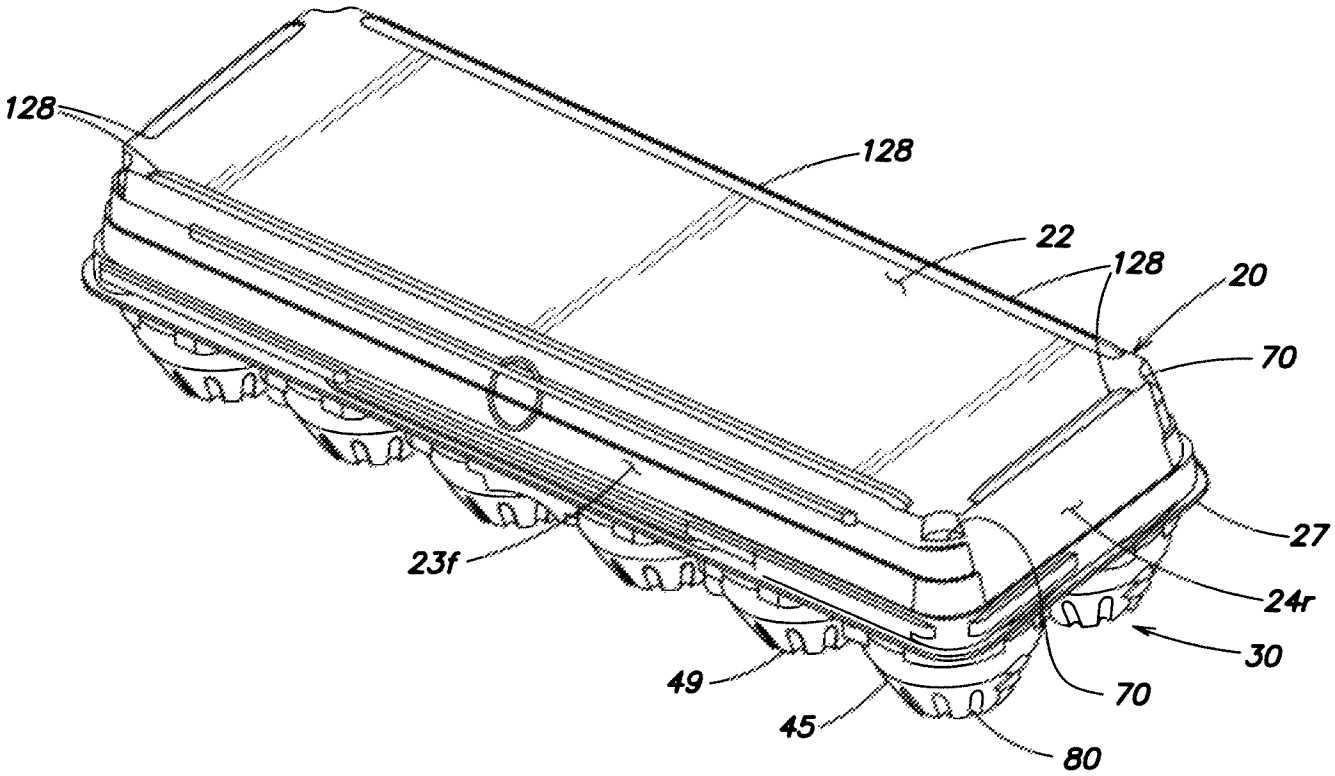
FIG. 3 is a top perspective view of the fully assembled carton of FIG. 1.
Figure 4:
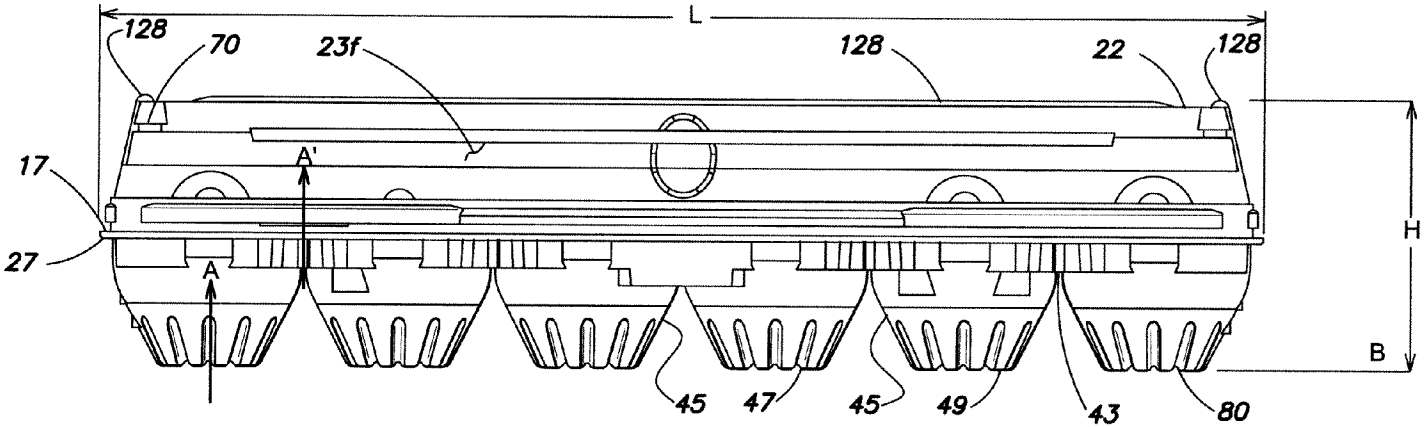
FIG. 4 is a side plan view of the fully assembled carton of FIG. 1.
Figure 5:
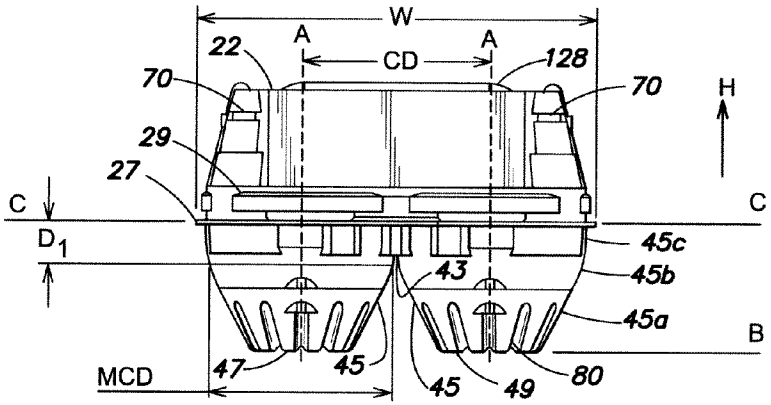
FIG. 5 is an end plan view of the fully assembled carton of FIG. 1.

In addition to the cell lid 20 and cell base 30, the carton 10 includes a cover 50 connected via a second hinge 51 to the base 30, the hinge 51 being disposed along the front longitudinal edge 31*f* of the base, opposite the first hinge 21 connecting the base to the lid on the opposing rear longitudinal edge 31*r* of the base. FIG. 2 illustrates the hinged cover 50 being rotated about hinge 51 (see arrow 1) to a position on top of the base, followed by rotating the lid 20 about hinge 21 (see arrow 2) to a position on top of the assembled cover and base. The fully assembled carton is shown in FIGS. 3-5.

Figure 13A:
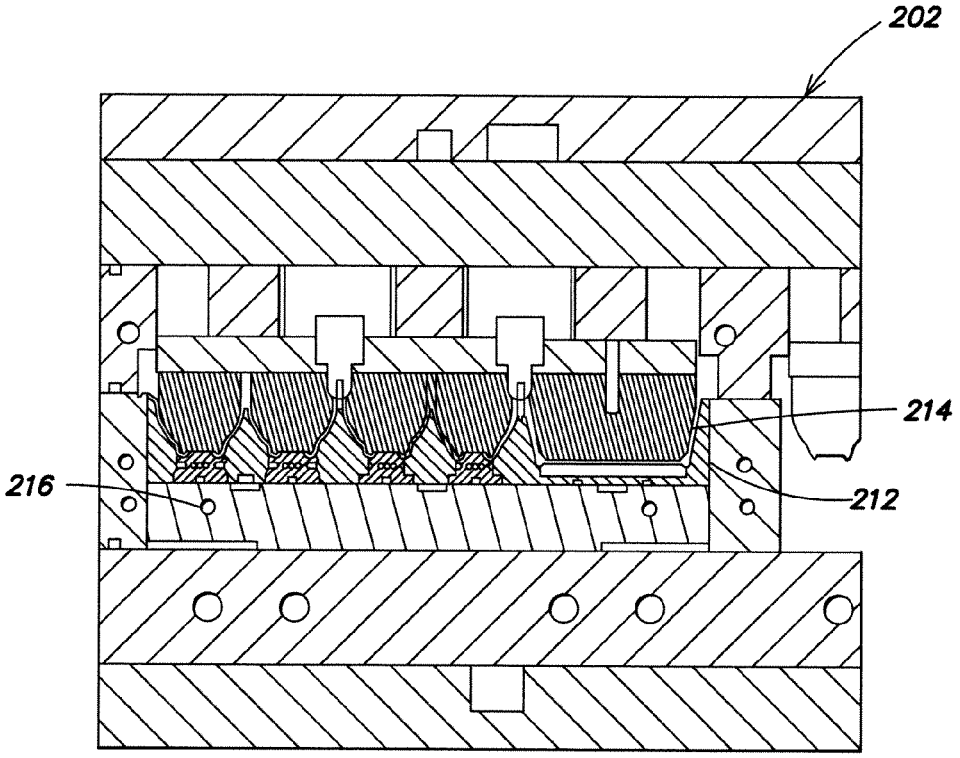
FIG. 13A is a schematic sectional view of a pressure mold with a plug assist for forming a carton with a turned up lip edge according to one embodiment of the invention.
Figure 13B:
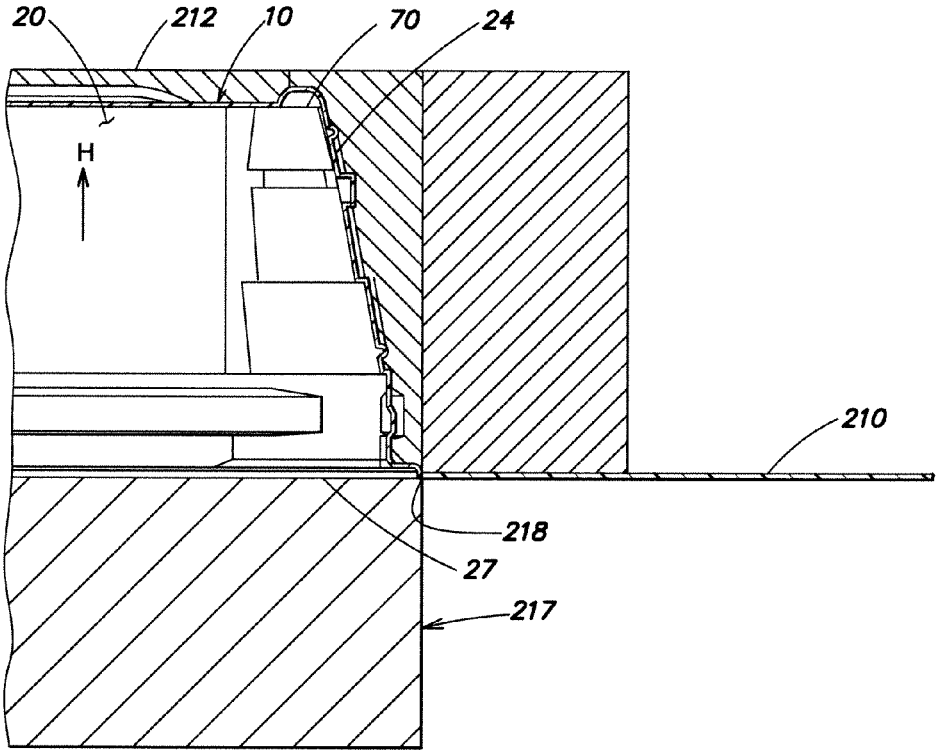
FIG. 13B is a schematic sectional view of a formed carton (as in the mold of FIG. 13A) being cut at a trim station to form the trim perimeter according to one embodiment of the invention.

In the present embodiment, the carton 10 is integrally formed from a sheet of molded plastic material, e.g., a clear solid sheet of polyester, such as polyethylene terephthalate (PET); alternative polymers are described below. The sheet from which the carton is integrally molded can then be shaped (formed) by a molding process, e.g., pressure forming with a plug assist in a mold to form the shaped lid, base and cover portions, including a turned up lip edge, and then removing (trimming) any remaining portions of the sheet to form an integral carton. FIGS. 13A-13B, described below, show one example of a method of making carton 10.

As shown in FIGS. 1-6, the lid 20 has a generally flat (planar) uppermost top wall 22 and a downwardly extending peripheral sidewall 23 having a lower edge 27 that mates with an upper edge 17 of the assembled cover and base. The lid is generally rectangular in shape and includes two opposing (left and right) lateral end walls 24*l* and 24*r* and two opposing longitudinal front and rear sidewalls 23*f* and 23*r*. The lid 20 further includes sidewall reinforcements, here comprising outwardly projecting grooves 29 (FIG. 1) aligned along each of the front longitudinal sidewall 23*f* and right and left lateral end walls 24*l* and 24*r*.

Figure 12:
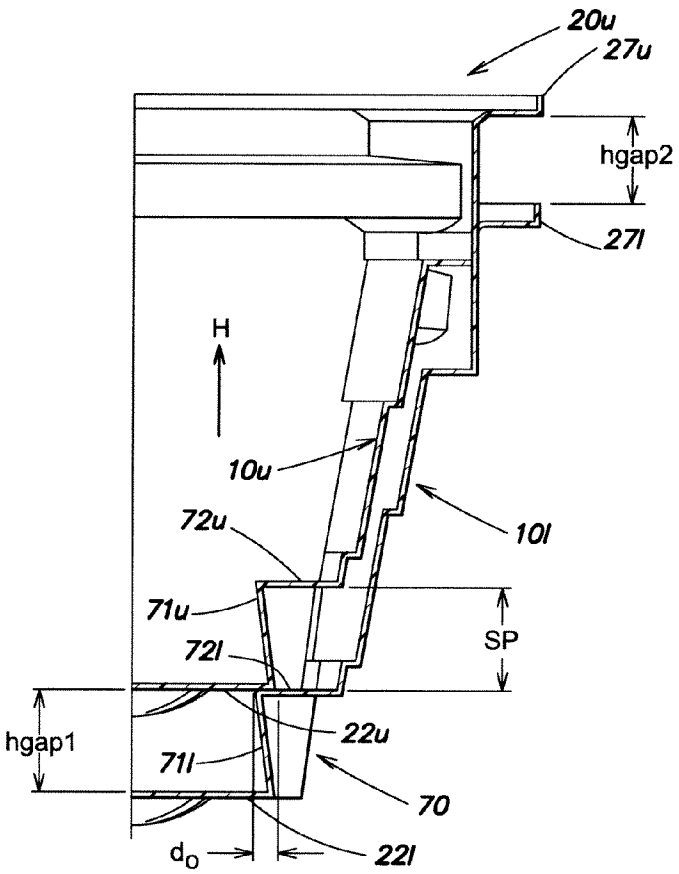
FIG. 12 is a lateral sectional view of two lids stacked one on top of the other showing engagement of the lid denesting lug(s) which facilitate stacking and unstacking of the empty open cartons.

In each of the four corners 25 of the lid, where a sidewall 23 joins an end wall 24, there are formed two shoulder portions 26*a*, 26*b* and a denesting lug 70, all of which increase the mechanical strength (stiffness) of the lid. A denesting lug 70 is disposed adjacent the upper corner where the sidewall 23 meets the top wall 22 of the lid. As best shown in FIG. 12, in the present embodiment each denesting lug has an arcuate sidewall portion 71 projecting inwardly towards the interior of the lid, and a flat interior top surface 72 on which a flat exterior top surface 72 of an adjacent cover lug rests when the lids of two open cartons are in a stacked position. FIG. 12 is a partial sectional view of upper and lower open stacked cartons 10*u* and 101 respectively, wherein a lid 20*u* of the upper carton 10*u* is stacked on a lid 20*l* of the lower carton 101, with the exterior corner lid surface of 22*u* of upper carton 10*u* resting on the interior top surface 72*l* of lug 70*l* of lower carton 101, thus forming a gap (hgap-l) between upper lid wall top 22*u* and lower lid top wall 221. The denesting lugs create a stack pitch (sp) equal to the height of the lug sidewall 71. The stacked lugs have overlapping edges along a distance ($d_o$), which varies with an angle between the lug sidewall 71 and the height axis H. The stacked lugs 70 produce a gap (hgap-2) between the turned up lip edges 27*u*, 27*l* of the upper and lower cartons respectively, enabling an operator to insert a finger in the gap (hgap-2) to separate the two lids/cartons, or enabling a picker of an automated handling equipment to separate the open stacked lids/cartons.

Apart from the two hinge connections 21, 51 at the rear and front longitudinal edges 31*r*, 31*f* of the base 30, all of the remaining top edges of the lid, base and cover have at their perimeter a new type of trim edge, referred to herein as a turned up lip edge. The base 30 and cover 50 have turned up lip edges 37 and 57 respectively that mate when the cover is disposed over the base in a closed position. The lid has a turned up lip edge 27 that is disposed over the mating edges of the cover and base in the assembled carton. As previously described this turned up perimeter lip edge in each of the lid, base and cover, provides stiffness and strength to the assembled carton and prevents injury (cuts), during handling.

In the prior art, the lid cover and base would each have a transverse perimeter edge, disposed in a plane substantially transverse to the height direction of the assembled container, and parallel to the base plane on which the base of the assembled carton rests. In contrast, according to the present invention a turned up lip edge is provided at the perimeter, disposed substantially parallel (e.g., within 5 degrees) to the height direction of the assembled container. FIG. 1A shows one example of a turned up lip edge 37*a*, here disposed along the left lateral edge of the base 30, the right lateral edge having a similar turned up lip edge. As shown in FIG. 1A, the turned up lip includes a junction 137 (e.g., radiused corner) between edge wall 37*a* disposed substantially in the height H direction and connecting wall 145 disposed substantially in the transverse direction, the connecting wall 145 in turn extending substantially transversely from the generally height oriented sidewall 45 of the base. At its terminal end 38*a*, the turned up lip edge 37*a* has a substantially flat surface lying in a plane C comprising the top perimeter edge of the base 30. The cover 50 has a similar turned up lip edge 57 along each of its opposing lateral edges (57*a* and 57*b*), and along its front longitudinal edge (57*c*). The lid 20 has a similar turned up lip edge 27 along each of its opposing left and right lateral edges (27*a* and 27*b*) and along its front longitudinal edge (27*c*).

Figure 11A:
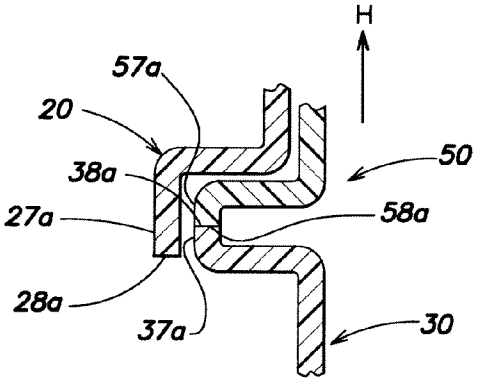
FIG. 11A is an enlarged sectional view of the lateral edge perimeter of the assembled carton of FIG. 3 showing the terminal ends of the turned up lip edges of the cover and base engaged, and the lip edge of the lid disposed over the assembled cover and base lip edges.
Figure 11B:
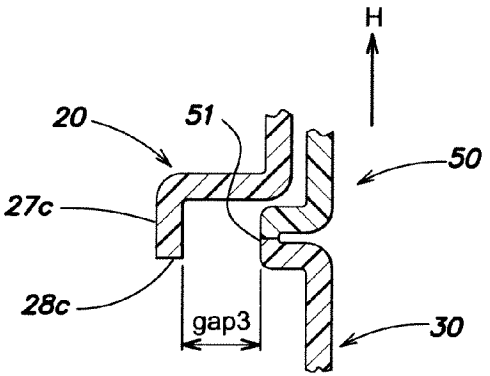
FIG. 11B is an enlarged sectional view of the longitudinal edge perimeter of the assembled carton of FIG. 3, showing the lip edge of the lid disposed over the closed hinge of the assembled cover and base.

FIG. 11A shows the turned up lip edge 27*a* of lid 20 extending over the engaged lateral lip edges 57*a*, 37*a* of the assembled cover and base. The engagement of the flat terminal ends 58*a*, 38*a* of lip edges 57*a* and 37*a* stiffen and strengthen the trim edge, enabling the carton to resist compressive forces in the height H direction. The trim edge 27 of the lid further strengthens the trim edge of the assembled container by engaging the outer contour of the cover lip edge 57. At the longitudinal front edge of the carton, as shown in FIG. 11B, the lip edge 27*c* of the lid 20 is disposed over and spaced apart from the hinge 51 that connects the cover 50 and base 30. The gap (gap3) between the hinge 51 and the lip edge 27*c* allows some lateral movement of the lid on the assembled cover and base, without transferring that movement to the assembled cover and base.

In contrast, the prior art carton has a straight trim edge, extending laterally, transverse to the height direction H. The straight trim edge of the prior art is formed by placing a plastic sheet face down on a forming machine, and directing a trimming knife (attached to the machine) to cut around the perimeter of the sheet against a backing surface. Alternatively, this trim step may be done at a separate trim station. In contrast, the turned up edge of the present invention is formed in a forming machine that shapes a plastic sheet into the lid, base and cover portions of the carton respectively, wherein the terminal ends (58, 28, 38) of the turned up edges (50, 20 and 30 respectively) are created by trimming (e.g., at a trim station). The flat terminal ends 58, 38 of each of the lip edges of the cover and base can engage, resting one upon the other, thus stiffing the assembled cover and base. Alternatively, the terminal ends 58, 38 may slide past one another, to one side or the other, but the adjacent edge walls and/or connecting walls of the trim edges 57, 37 can still engage in a friction fit to strength the cover and base assembly.

There will now be provided a more detailed description of the cell and post structure of the cell base and a cell cover which, when assembled, form the array of cell pockets each holding an individual egg.

As shown in FIGS. 1-6, the base portion 30 of the carton 10 comprises a 2×6 matrix of egg-receiving cells 40, aligned along rows and columns of the cell matrix, each cell being formed to receive and accommodate a single egg. Each cell has a central cell axis A that extends axially down the center of the cell in the height H direction of the carton (FIGS. 5 and 7). Typically the axis A is disposed laterally (about 90 degrees) to the bottom plane B on which the bottom walls of the base cells rest. Each cell 40 has a sidewall 45 having an interior receiving surface contoured to receive the ovoid shape of an egg. The sidewall 45 extends upwardly from a bottom cell wall 47 to define an open top end 46 of the cell. Two adjoining sidewalls 45, 45 between adjacent pairs of cells 40, 40, together define a cell junction 43, also referred to as a cell divider. The cell junction 43 preferably includes a rounded shoulder portion forming a top edge 48 of the joined sidewalls. The sidewalls 45 are generally flexible to respond to pressure applied during packaging, transportation and/or storage of the eggs.

The cover 50 has complimentary cells arranged in the same 2×6 matrix, and together with the base cells, form the cell pockets for protecting each egg in an individual cell pocket. The complementary features of the cover cells are referenced by a 100 number series corresponding to the respective features of the base cells (e.g., base cell 40 has sidewall 45 and cover cell 140 has sidewall 145).

The sidewall 45 of base cell 40 extends upwardly from a cell bottom wall 47, in the direction of the cover 50, when the hinged cover is positioned over the base (as in FIGS. 3-5). The cells 40 that collectively form the base 30 have at least some area of their exterior bottom surfaces 49 that are substantially co-planar and lie substantially within a common plane B on which the carton rests (see FIG. 5). This allows the planar bottom of one carton to be mechanically stacked or deposited on top of the uppermost planar lid surface 22 of another carton (see FIGS. 14-15). By force of gravity, the bottom surfaces 49 bear against the top surfaces 22 to provide a degree of stability against lateral (LAT) or longitudinal (LONG) movement due to friction between the top surface 22 and bottom surfaces 49. Further, in the present invention the lid has a raised lip 128 extending outwardly along each of the lateral and longitudinal edges of the lid top wall 22, which lip 128 forms a boundary for containing the bottom surfaces 49 of the cells of an adjacent carton that is positioned on top of the lid of the lower carton.

Each cell 40 has a generally circular cell bottom wall 47 (see FIGS. 6-7), including an outermost standing ring 49 on which the carton rests in common plane B, and an adjacent recessed ring 44*a*, the center of the ring forming an outwardly projecting dome 44*b*. The top end or bottom end of an egg 4 will rest on the interior surface of the dome 44*b*. The cell sidewall 45 has sidewall portions 45*a*, 45*b* and 45*c* (see FIG. 5) which extend upwardly in relative order from the circular standing ring 49. More specifically, the sidewall 45 includes a lower portion 45*a* which is substantially linear (planar) and extends upwardly and outwardly with respect to the standing ring 49 (plane B); the lower portion 45*a* includes a plurality of radial grooves 80 extending upwardly from the bottom wall 47 for strengthening the cell sidewall. A middle portion 45*b* of the sidewall is arcuately curved (bowed) outwardly to accommodate the ovoid shape and maximum egg diameter of a jumbo egg; in particular the sidewall portion 45*b* is sized and shaped to allow a jumbo egg, whether in an oriented or non-oriented position in the cell, to rest on (engage) the arcuate sidewall portion 45*b*, while the top or bottom end of the egg sits in the dome 44*b* in the cell base wall (see FIGS. 8-9). A third upper portion 45*c* of the sidewall forms a substantially linear (planar) transfer shoulder extending upwardly (substantially parallel to the height H of the cell and carton).

Figure 6:
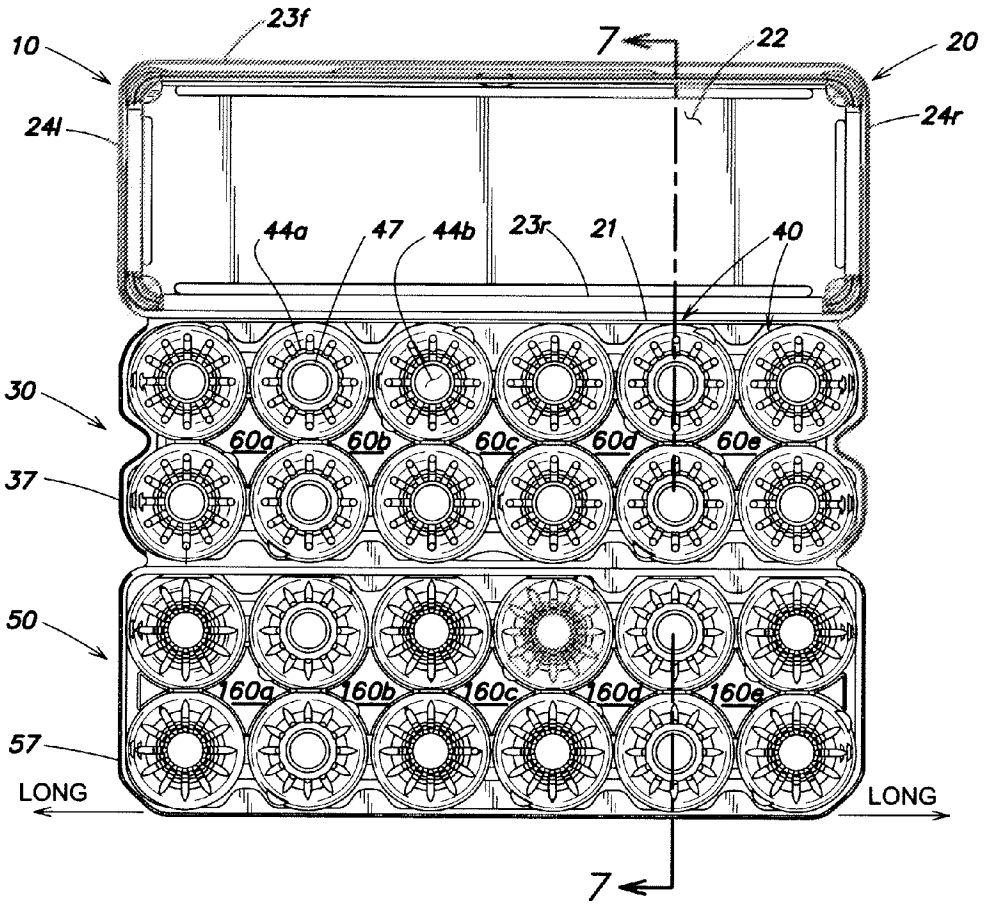
FIG. 6 is a top plan view of the egg carton of FIG. 1 in an open position.

A cell post 60 is formed at each intersection (i.e., cross-hair (+)) of four adjacent (2×2 matrix of) cells 40 in the base 30, the cell post comprising an extension 64 of the intersecting sidewalls 45 of the four cells, and having a top planar cell post wall 61 disposed substantially in the same plane C as the uppermost base perimeter (see FIGS. 6-7). The cell post has a central axis A' that extends axially down the center of the cell post 60 (see FIGS. 1 and 4) and is aligned with the height direction H of the carton. The cell post is generally tubular in shape and typically hollow. Typically, axis A' is disposed laterally (about 90 degrees) to the bottom plane B of the carton 10 on which the bottom-most extending surfaces 49 on the outer side of the egg cells 40 of base rest. The cells 140 of cover 50 have similar sidewall extensions 164 to those in the base cells 40. The cover 50, hingedly connected to the base, has a complimentary row of five cell posts 160*a*-160*e* which extend downwardly towards the base for mating with the upwardly extending cell posts 60*a*-60*e* of the base when the cover 50 is aligned over the base 30 in a closed position (FIGS. 3-5). The cell posts of the cover and base have complimentary top planar surfaces 61, 161 for mating when the cover is positioned over the base. As used herein, "mating" means adapted to prospectively contact or be disposed in close proximity to; actual contact between the mating surfaces may occur whenever the cover and base are in a closed position, or only when in a closed position and an additional force is applied to the carton, e.g., when stacking the cartons one on top of another and/or stacking side by side and/or moving the cartons.

In the present embodiment, the center distance CD between adjacent cells (see FIG. 5) and the dimensions of the cell dividers 43, 143 and cell posts 60, 160 are dimensioned to allow each cell pocket to hold up to a jumbo size egg, without expanding the overall egg carton footprint (i.e., length L, width W, and height H) of the carton beyond the standard footprint that a non jumbo cell size egg carton requires.

Each sidewall extension 64 that forms a part of a cell post 60, follows the ovoid contour of an egg disposed in the cell and extends to the full height of the plane C in which the trim perimeter of the base lies (this is also true for the cell post 160 of the cover). At the sidewall junction (cell divider) 43 between each two adjacent cells 40, a groove 15 may be formed to further strengthen the cell pocket structure. However, this groove is sufficiently narrow as to substantially avoid any side-to-side contact between the eggs in the respective adjacent cell pockets. Thus, each egg is held in a separate enclosure (cell pocket), out of contact with eggs in the adjacent cell pockets. Preferably, as shown in FIG. 7, the sidewall extension 64 forms a cell divider have a depth $d_1$ (substantially aligned with the height H of the carton), and extending downwardly from the top wall of the cell post (plane C) a distance from about 0.25 to about 0.50 inches.

In the present embodiment, the assembled carton holds 12 jumbo eggs in a 2×6 matrix of cell pockets and has an overall length L of from about 11.62 to about 11.75 inches, a width W of from about 3.95 to about 4.00 inches, and height H of from about 2.62 to about 2.75 inches.

FIGS. 13A-13B are schematic sectional views of an apparatus and method for making a carton 10 in accordance with one embodiment of the invention. FIG. 13A shows a molding apparatus 202 which includes a female mold cavity 212 and a plug assist 214 for pressure forming a carton 10 with turned up lip edges 27, 37 and 57 on the lid, base and cover respectively, in the mold. A continuous sheet of plastic is fed to the mold and is formed by the plug assist 214 pushing the sheet toward the female cavity 212 in combination with the application of a vacuum on the exterior side of the sheet/carton to draw the sheet into the corners of the mold cavity 212. FIG. 13A shows the plugs for forming each of the lid, base and cover sections of the carton 10, and the corresponding female cavity sections for each, as well as channels 216 in the mold for applying a negative pressure on the exterior of the sheet to assist in forming the carton between the plugs 214 and female cavity 212.

The formed carton is then trimmed at a separate trim station shown in FIG. 13B. Here the carton 10 is shown between the female die cavity 212 and a cutting edge punch 217 having a knife edge 218, the cavity and punch being brought together to sever (cut) the lip edges (27, 37, 57) from the sheet 210 to form the terminal ends (28, 38, 58) of the lip edges, in a direction aligned with the height H direction (arrow H) of the carton. Other forming and trimming methods known to those skilled in the art can be used for forming the carton and turned up lip edge of the present invention.

Figure 14A:
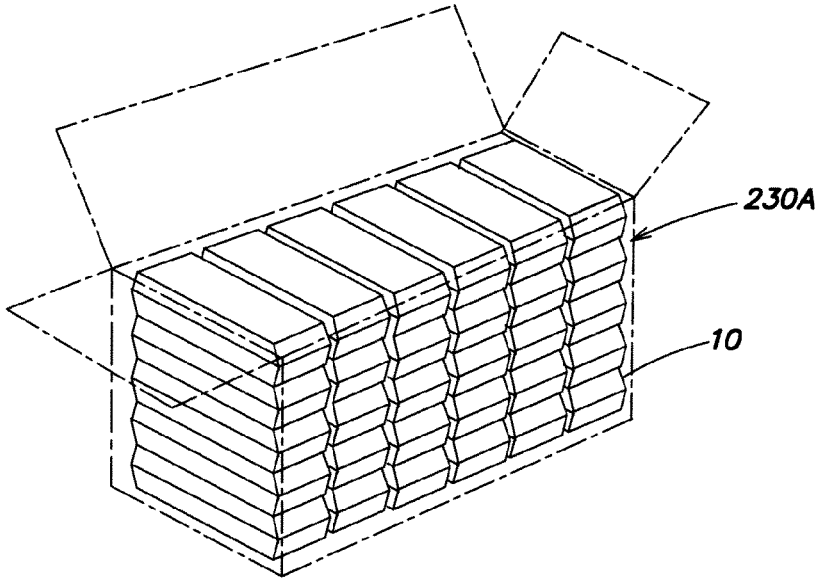
FIGS. 14A-D are perspective views of different stacking patterns of cartons packed in differently sized containers.
Figure 14B:
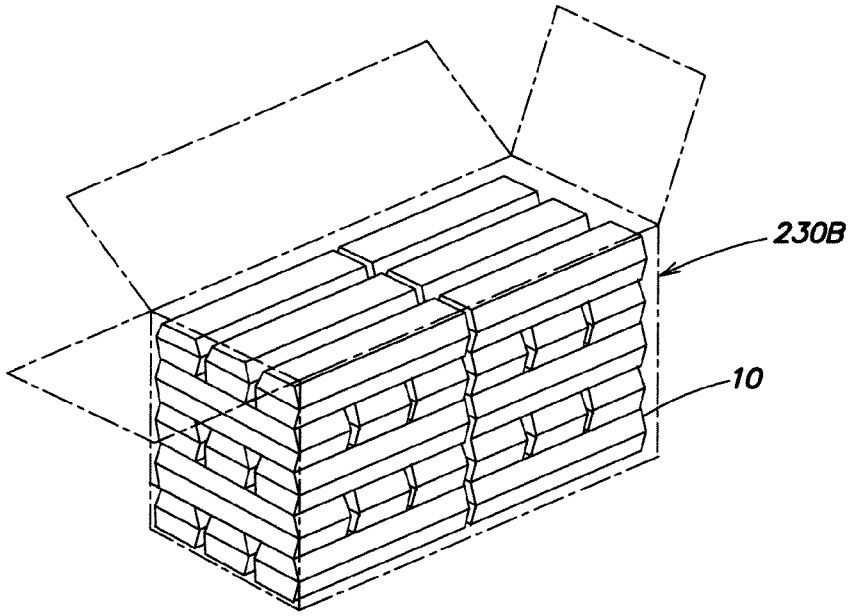
Figure 14C:
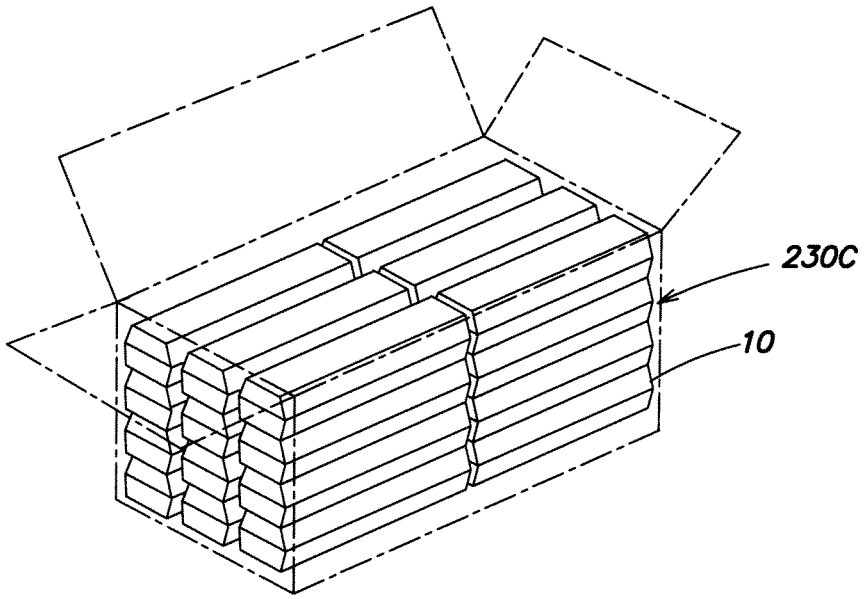
Figure 14D:
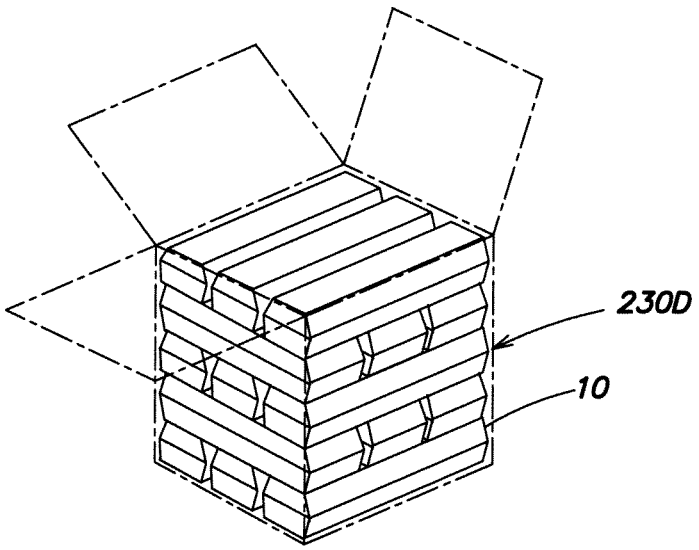

The filled egg cartons 10 may be enclosed in outer containers in various stacking patterns. FIG. 14A shows a full case rectilinear paperboard container 230A a holding a 6×5 array of 30, 2×6 egg cartons, stacked in parallel arrangement. The case 230A of FIG. 14A has inner dimensions of about: 23⅞ inches×11⅞ inches×13¾ inches. FIG. 14B shows a similar full case container 230B holding 30, 2×6 egg cartons, but stacked in a cross stacking arrangement, wherein successive vertical layers are disposed transverse to the adjacent layer. Alternatively, a half case rectilinear container 230D shown in FIG. 14D holds 15, 2×6 egg cartons, in a 3×5 carton matrix, cross stacked. The 15-dozen half case container has inner dimensions of about: 11⅞ inches×11⅞ inches×13⅝ inches. In another embodiment (not shown), the 15-dozen half case container has inner dimensions of about: 12 inches×11⅞ inches×13½ inches. In a further embodiment, shown in FIG. 14C, a 24-dozen rectilinear case container 230C has all of cartons 10 aligned along the longitudinal direction, 3 cartons in width and 4 cartons in height, the container 230C having inner dimensions of about: 23½ inches×11⅞ inches×11 inches.

In accordance with previously described embodiments of the invention, wherein a 2×6 egg carton is provided having a standard footprint but which accommodates jumbo size eggs, the above-described standard full case and half case containers can be used for jumbo size eggs, without increasing the dimensions of the full case or half case containers.

Figure 15A:
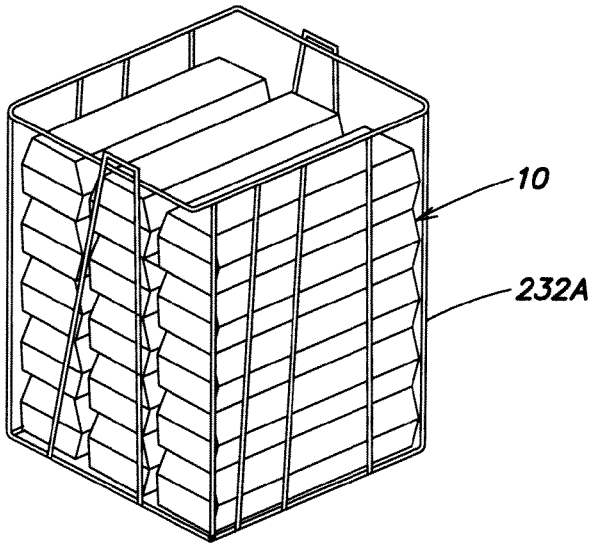
FIGS. 15A-B are perspective views of different stacking patters of cartons in wire baskets.
Figure 15B:
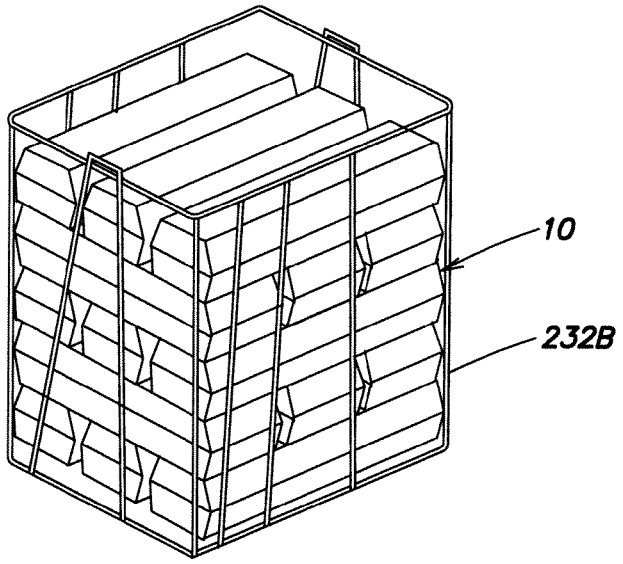

In alternative embodiments shown in FIG. 15, the egg cartons 10 can be stacked in wire baskets 232. FIG. 15C shows parallel stacking of 15, 2×6 matrix cartons, in a wire basket 232A. FIG. 15D shows cross stacking of 15, 2×6 matrix cartons, in a wire basket 232B.

In various embodiments, the plastic material of the egg carton is preferably one or more of polystyrene (e.g., polystyrene foam), polyester (e.g., polyethylene terephthalate (PET)), polyolefin (e.g., polyethylene (PE), polypropylene (PP)), or poly(lactic acid (PLA), including homopolymers, copolymers, mixtures and blends thereof, and including virgin and reclaimed (recycled) materials.

While specific embodiments of the present invention have been shown and described, it will be apparent that many modifications can be made thereto without departing from the scope of the invention. Accordingly, the invention is not limited by the foregoing description.

The invention claimed is:

1. A tri-fold plastic egg carton comprising:

a cell base, and a cell cover hingedly connected to one edge of the cell base for pivoting between open and closed positions, the cell base and cell cover each having a matrix of cells that together form a matrix of cell pockets for holding individual eggs when the cell cover is closed over the cell base;

a lid hingedly connected to another edge of the cell base for pivoting between open and closed positions, wherein when the cell cover and cell base are in the closed position the lid can be closed over the cell cover to form an assembled carton;

the non-hinged peripheral edges of the lid, cell cover and cell base each having a connecting wall parallel to a base plane on which the cell base of the assembled carton rests, a radiused corner, and a turned up lip edge substantially aligned with an axis transverse to the base plane, the ends of the lip edges of the cell cover and cell base mating when the cell cover is closed over the cell base, and the lip edge on the lid is disposed over the mating lip ends of the cell cover and cell base when the lid is closed over the cell cover.

2. The egg carton of claim 1, wherein the carton comprises a formed sheet of clear solid polyester having a thickness in a range of about 0.013 to about 0.022 inches.

3. The egg carton of claim 1, wherein each base cell has an outwardly bowed sidewall portion sized to receive a major cell diameter of a jumbo egg.

4. The egg carton of claim 3, the major cell diameter is in a range of about 1.75 to about 2.0 inches.

5. The egg carton of claim 1, wherein each cell has a sidewall and the sidewalls of two adjacent cells form a cell divider which prevents contact between eggs in the adjacent cells.

6. The egg carton of claim 5, wherein the cell divider has a depth of from about 0.25 to about 0.50 inches, wherein the depth is measured transversely from a top plane in which the trim perimeter of the base or cover respectively lies, the top plane being substantially parallel to the base plane.

7. The egg carton of claim 1, wherein the assembled carton has a length of from about 11.62 to about 11.75 inches, a width of from about 3.95 to about 4.00 inches and a height of from about 2.62 to about 2.75 inches.

8. The egg carton of claim 1, wherein the assembled carton is filled with jumbo size eggs of between 2.50 and 2.75 ounces per egg.

9. A stack comprising a plurality of assembled egg cartons of claim 7 arranged in a stack.

10. The stack of claim 9, further comprising a container holding the stack.

11. The stack of claim 10, wherein the container holds a full case or half case of the egg cartons.

12. The egg carton of claim 1, wherein the plastic is one or more of polystyrene, polyester, polyethylene, or polylatic acid, including polymers, copolymers, mixtures and blends thereof.

13. The egg carton of claim 1, wherein the carton comprises a clear solid formed sheet of polyester.

14. The egg carton of claim 1, wherein the carton comprises a formed sheet of polystyrene foam.

15. The egg carton of claim 1, wherein the lid has a lid sidewall which includes denesting lugs.

16. The egg carton of claim 15, wherein the lid sidewall has corners and the denesting lugs are disposed in the corners.

17. A tri-fold plastic egg carton comprising:

a cell base and a cell cover hingedly connected to one edge of the cell base for pivoting between open and closed positions, the cell base and the cell cover having respective peripheral edges that mate with each other in the closed position, and each of the cell base and the cell cover having a complimentary 2×6 matrix of cells that, when the cover is closed over the cell base, the cells of the cell cover and cell base are aligned and form a 2×6 matrix of cell pockets for holding individual eggs, each cell having a bottom and a sidewall extending upwardly from the bottom to form a corresponding one of the cells, a cell post formed at an intersection of four adjacent cells as an extension of the sidewalls of the four adjacent cells and having a central mating surface, wherein when the cell cover is in the closed position over the cell base the central mating surfaces of the cell posts of the cell base and cell cover mate with one another, a lid hingedly connected to another edge of the cell base for pivoting between open and closed positions, wherein when the cell cover and cell base are in the closed position the lid can be closed over the cell cover to form an assembled carton, the non-hinged peripheral edges of the cell base, cell cover and lid each having a connecting wall parallel to a base plane on which the cell base of the assembled carton rests, a radiused corner, and a turned up lip edge substantially aligned with an axis transverse to the base plane, the ends of the lip edges of the cell cover and cell base mating when the cell cover is closed over the cell base, and the lip edge on the lid is disposed over the mating lip ends of the cell cover and cell base when the lid is closed over the cell cover, and each cell pocket is sized to hold a jumbo egg, of from 2.50 and 2.75 ounces per egg, in an oriented or a non-oriented direction in the base cell.

18. The egg carton of claim 17, wherein each cell sidewall includes:

an outwardly bowed portion between upper and lower substantially linear portions, and wherein the outwardly bowed portion has a diameter in a range of about 1.75 to about 2.0 inches adapted to receive a major diameter of a jumbo egg.

19. The egg carton of claim 18, wherein the sidewalls of two adjacent cells form a cell divider, the cell divider having a depth, of from about 0.25 to about 0.50 inches, wherein the depth is measured transversely from a top plane in which the trim perimeter of the base or cover respectively lies, the top plane being substantially parallel to the base plane.

* * * * *